US006317087B1

(12) United States Patent
Laugal et al.

(10) Patent No.: US 6,317,087 B1
(45) **Date of Patent: *Nov. 13, 2001**

(54) ANTENNA DETENT AND LATCHING SYSTEM FOR SATELLITE PHONES

(75) Inventors: John Chip Laugal, South Barrington; Kenneth John Roback, Arlington Heights; Fredrick C. Becker, Fox Riber Grove, all of IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/569,423

(22) Filed: May 12, 2000

(51) Int. Cl.[7] ..... H01Q 4/24
(52) U.S. Cl. ..... 343/702; 343/882; 439/916
(58) Field of Search ..... 343/702, 906, 343/882; 439/906, 915, 916, 692, 693; H01Q 1/24

(56) References Cited

U.S. PATENT DOCUMENTS

| | | | | |
|---|---|---|---|---|
| 4,074,271 | | 2/1978 | Sakuma | 343/882 |
| 5,218,369 | | 6/1993 | Jennings | 343/702 |
| 5,271,684 | | 12/1993 | Phillips | 403/106 |
| 5,559,522 | | 9/1996 | Seitz | 343/702 |
| 5,603,630 | | 2/1997 | Villain | 439/347 |
| 6,062,912 | * | 5/2000 | Witczak et al. | 439/680 |
| 6,091,368 | * | 7/2000 | Mitchell et al. | 343/702 |
| 6,107,968 | * | 8/2000 | Stalgren et al. | 343/702 |
| 6,157,350 | * | 12/2000 | House et al. | 343/906 |
| 6,166,695 | * | 12/2000 | Witczak et al. | 343/702 |

FOREIGN PATENT DOCUMENTS

| | | |
|---|---|---|
| 2195841A | 4/1988 | (GB) . |
| 5-327328 | 12/1993 | (JP) . |
| WO 98/47199A1 | 10/1998 | (WO) . |

OTHER PUBLICATIONS

U.S. application Serial No. 09/165,843, Docket No. CS90016–Witczak et al., filed Oct. 2, 1998 by Motorola, Inc.

* cited by examiner

*Primary Examiner*—Tho Phan
(74) *Attorney, Agent, or Firm*—Lalita P. Williams; Hisashi David Watanabe

(57) ABSTRACT

An antenna detent and latching mechanism (300) for coupling to a radiotelephone and mating with a radiotelephone antenna stem (200) is provided. The antenna detent and latching mechanism (300) includes a bottom plate (380) for mounting the mechanism in the radiotelephone, a bearing plate (360) coupled to the bottom plate, a detent follower (373) coupled to the bearing plate (360) and engaging a plurality of detents (366, 368, 370) in the bearing plate (360), and a detent spring (374) coupled to the detent follower (373) and providing force against the detent follower (373). The detent spring (374) is preferably a substantially flat leaf spring. The detent follower (373) preferably has a plurality of detent spring contact surfaces (377, 378). The detent spring (374) may be supplemented with additional detent springs (375).

20 Claims, 8 Drawing Sheets

ANTENNA DETENT AND LATCHING SYSTEM FOR SATELLITE PHONES

FIELD OF THE INVENTION

The present invention relates generally to systems for making rotatable connections in a radiotelephone system. Although the invention is useful for a wide range of applications, it is especially suited for use in a satellite radio communications system and will be particularly described in that context.

BACKGROUND OF THE INVENTION

A cellular radiotelephone system consists of a number of base stations and radiotelephone handsets. The user receives and places radiotelephone calls through the handset, which is in radio communication with one of the base stations.

A satellite radio communications system, such as the IRIDIUM® system, has a network of satellites in a low earth polar orbit, each satellite performing the same function as a base station. The satellites transmit and receive signals from a satellite subscriber unit (SSU) to form a radiotelephone system, allowing users to place radiotelephone calls from almost anywhere in the world to almost anywhere else in the world.

Unlike cellular systems, the satellites do not remain in the same place with respect to the surface of the earth. Since the satellite could be anywhere in the hemisphere above the user, the SSU's antenna preferably has a gain pattern that covers the hemisphere above the user. Thus, designers have developed an antenna with a hemispherical gain pattern.

In order for an SSU to communicate with any of the possible low earth orbit satellites, the SSU's antenna needs to be oriented in a vertical position with respect to the ground. This orientation is to be maintained regardless of whether the user is holding the SSU in his or her right or left hand.

U.S. Pat. No. 5,559,522 describes an antenna positioning apparatus capable of substantially vertical orientation of a radiotelephone antenna with respect to the ground. Although the antenna positioning system described can be useful in some radiotelephone configurations, it may not operate properly in all such configurations, for example configurations wherein the antenna does not include a wedge shaped mating surface. Thus, there is a need for an alternative apparatus that maintains the antenna in a vertical position with respect to the ground when an SSU is transmitting or receiving. Because signals transmitted between a satellite and an SSU have to travel farther distances than signals in a cellular system, there is an additional need for an apparatus that provides a robust electrical connection as the SSU's antenna is rotated to an active position with respect to the SSU's handset.

SUMMARY OF THE PREFERRED EMBODIMENT

The present invention provides an antenna detent and latching mechanism that can be used with a radiotelephone antenna to maintain the antenna in selected positions with respect to the radiotelephone. The antenna detent and latching mechanism includes a bottom plate for mounting the mechanism in the radiotelephone; a bearing plate coupled to the bottom plate, wherein the bearing plate interfaces with the antenna stem to provide positioning of the antenna stem with respect to the radiotelephone; a detent spring coupled to the bottom plate and providing force against the bearing plate to assist in positioning; a middle plate coupled to the bearing plate and retaining the antenna stem in a first deployed position or a second deployed position; a latch member coupled to the middle plate and moveable to allow the antenna stem to be coupled to the mechanism; a leaf spring coupled to the latch member; a button for actuating the latch member to install and remove the antenna stem; and a top plate coupled to the latch member for aligning the mechanism.

DETAILED DESCRIPTION OF A PREFERRED EMBODIMENT

The following detailed description is exemplary and explanatory only and is not restrictive of the invention as claimed. The accompanying drawings illustrate the preferred embodiment of the invention and together with the description serve to explain the principles of the invention. Reference will now be made in detail to the present preferred embodiment of the invention.

Figure 1:
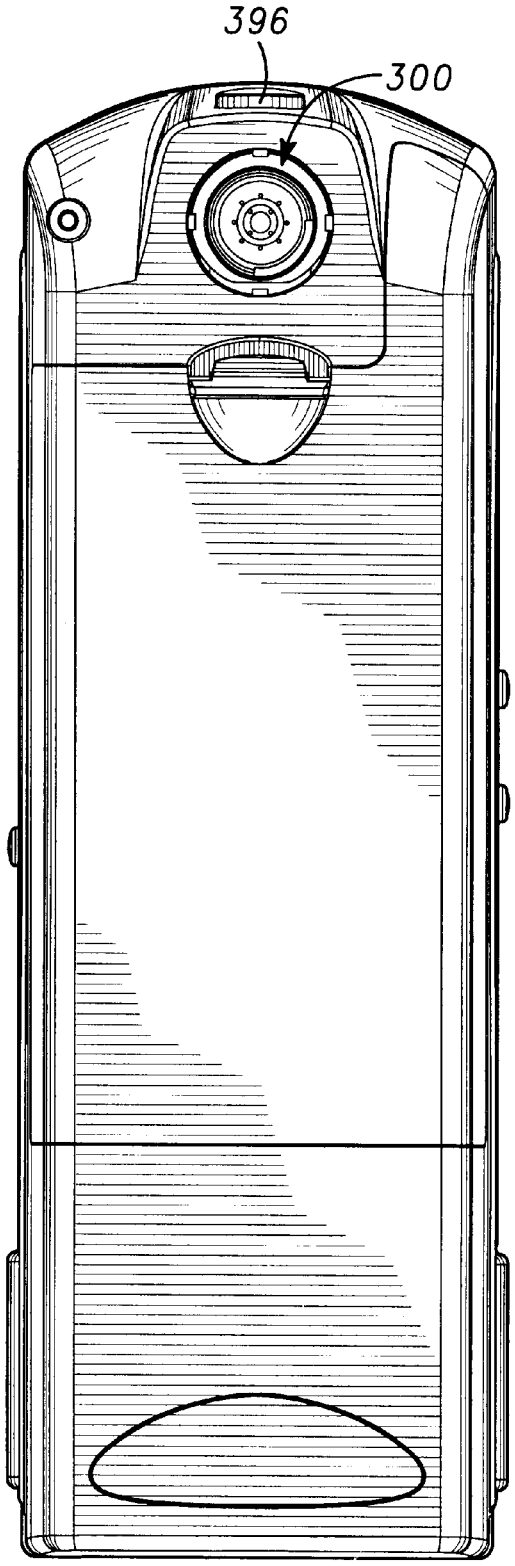
FIG. 1 is a rear view of an SSU handset which incorporates the preferred embodiment of the antenna detent and latching mechanism of the present invention.
Figure 2:
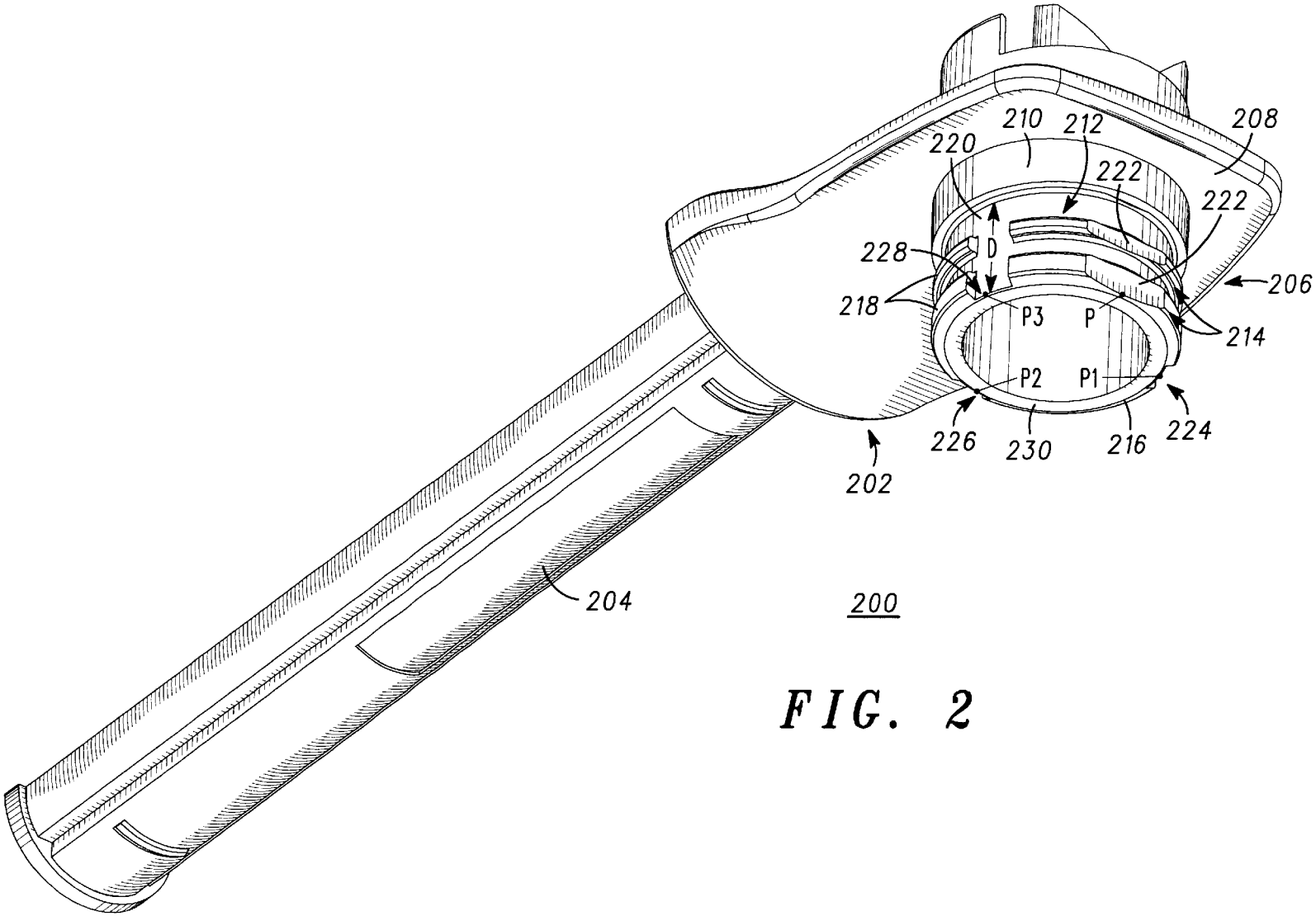
FIG. 2 is a front, top and left perspective view of the preferred embodiment of an antenna stem that can be used with the antenna detent and latching mechanism of the present invention.
Figure 9:
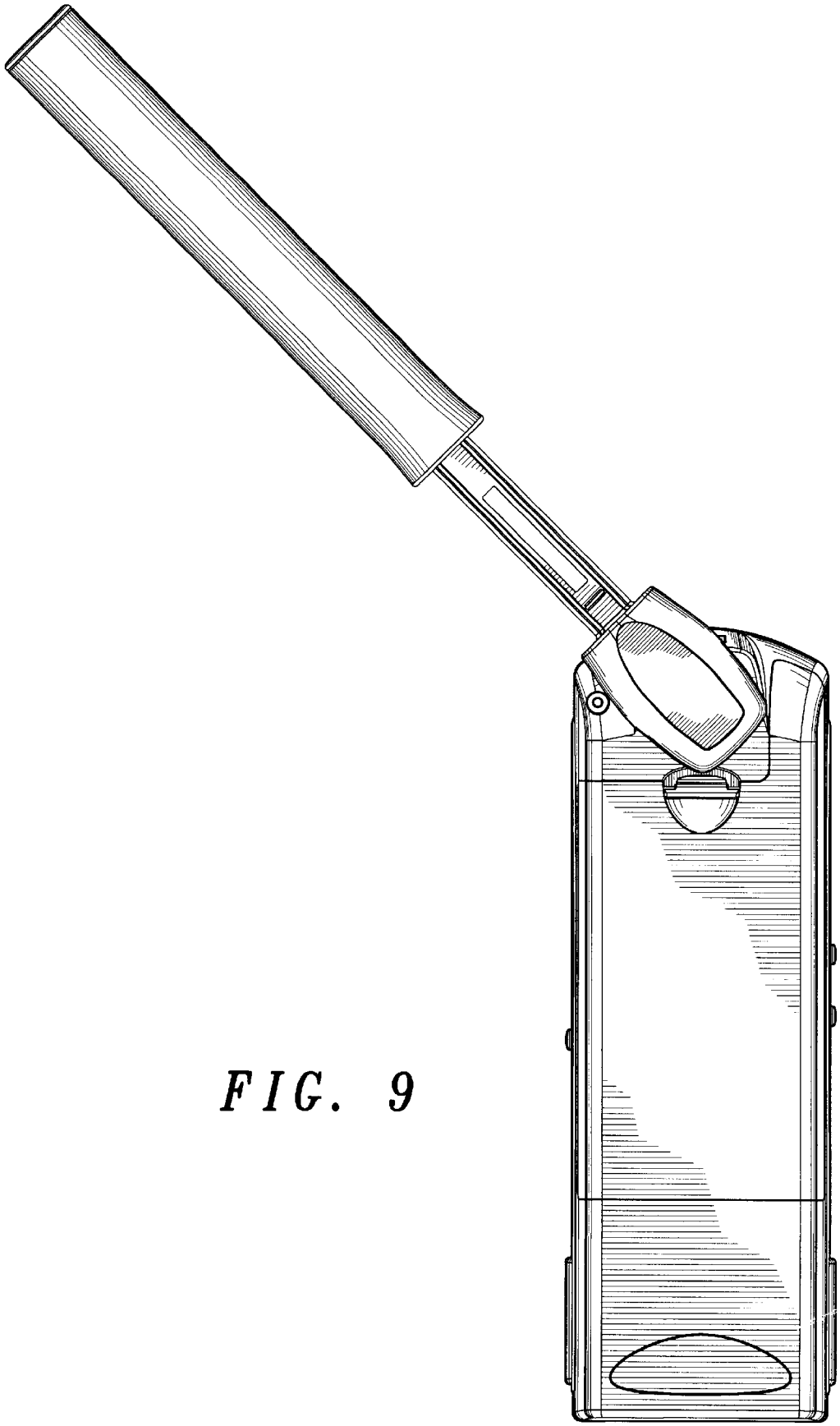
FIG. 9 is a rear view of an SSU with the antenna in a first deployed position.
Figure 10:
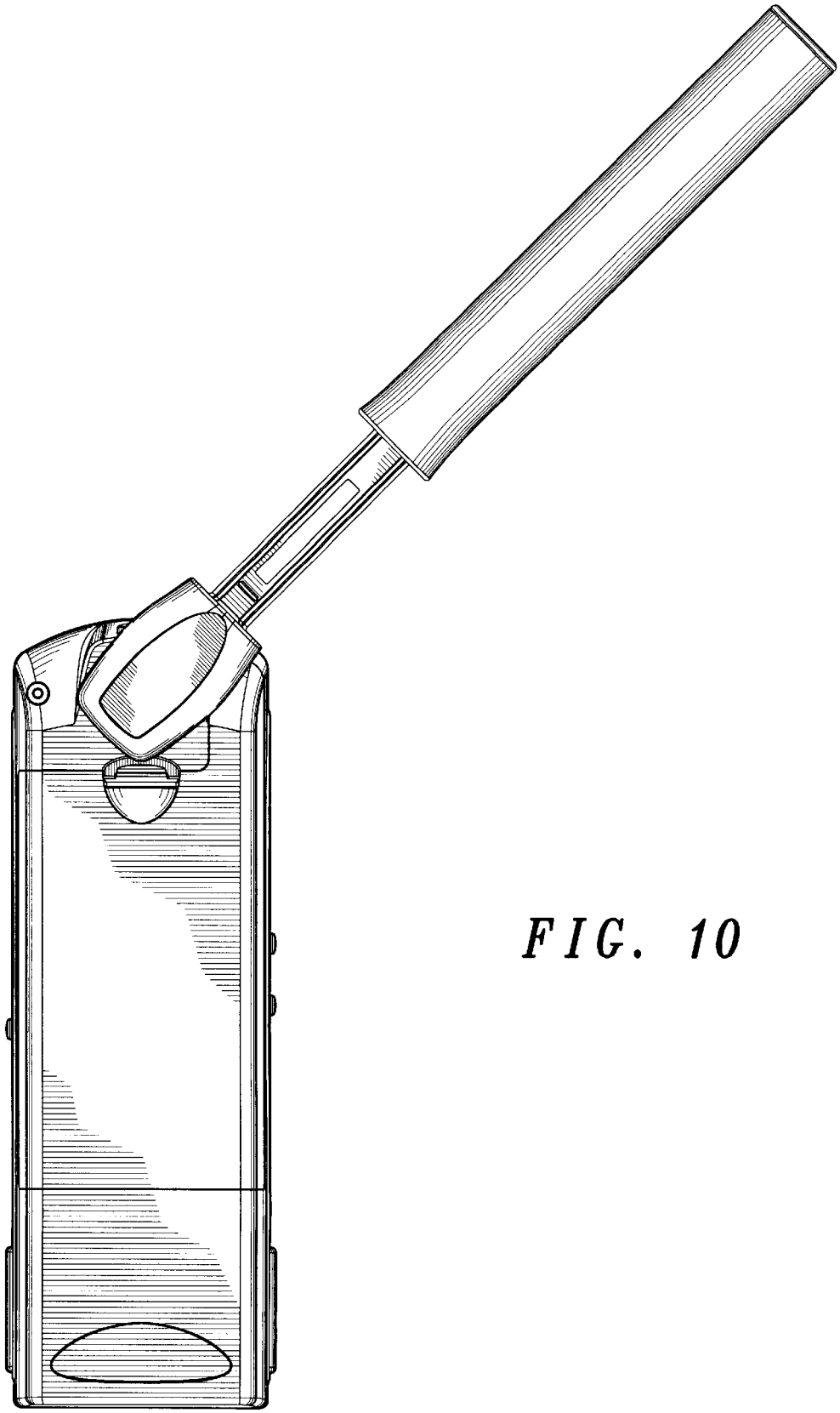
FIG. 10 is a rear view of an SSU with the antenna in a second deployed position.

FIG. 1. shows a rear view of an SSU handset 100 that can implement the antenna detent and latching mechanism ("mechanism") 300 of the present invention. FIG. 2 shows a front, top and left side perspective view of an antenna stem 200 of an SSU antenna 800 (FIG. 8) that mates with the mechanism 300. When mated, the antenna stem 200 can be rotated from a stowed position and locked in a first deployed position or a second deployed position (FIGS. 9 and 10). In the preferred embodiment, the antenna stem 200 is preferably injection molded using polycarbonate and includes a base 202, a leg 204 coupled to the base 202, and a raised wall 206 coupled to a top side 208 of the base 202. The raised wall 206 is generally cylindrical having a first section 210 and a second section 212. Disposed along the outer surface 220 of the second section 212 is a plurality of pairs of ridges 214, 216, 218, preferably three. Ridges 214 have a flat section 222.

The raised wall 206 includes a plurality of key receptacles 224, 226, 228, preferably three. Specifically, the spacing between ridges 214 and ridges 216 forms a first key receptacle 224 centered around a point P1 located approximately 80° from a point P which represents the center of the flat section 222 of ridges 214. The spacing between ridges 216 and ridges 218 forms a second key receptacle 226 centered around a point P2 located approximately 190° from point P. The spacing between ridges 218 and ridges 214 forms a third key receptacle 228 centered around a point P3 located approximately 290° from point P. Preferably, the key receptacles 224, 226, 228 extend a depth D of 8.5 mm.

Figure 3:
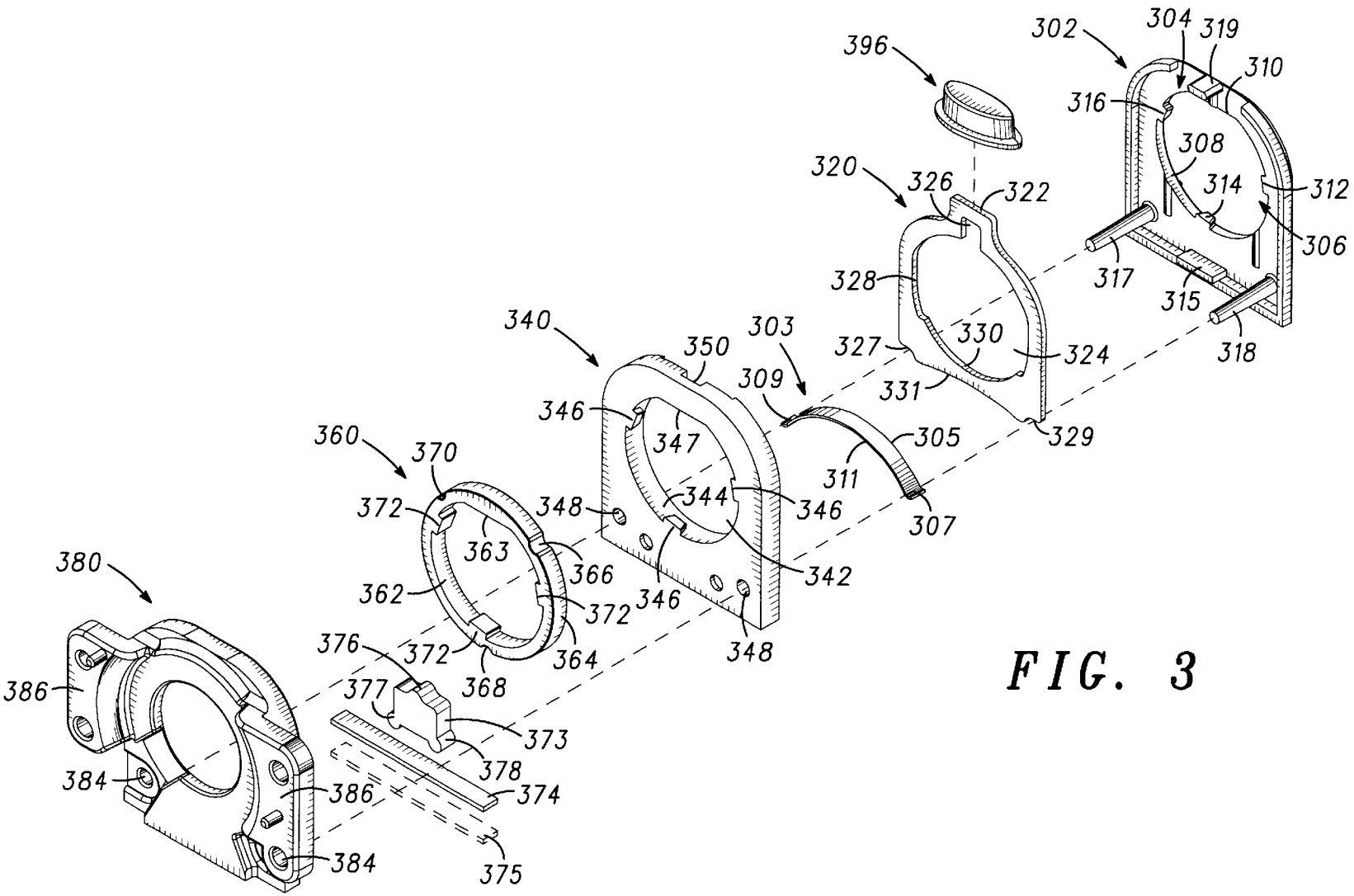
FIG. 3 is an exploded view of the preferred embodiment of the antenna detent and latching mechanism of the present invention.

FIG. 3 shows an exploded view of the preferred embodiment of the mechanism 300 of the present invention. The mechanism 300 includes a top plate 302; a latch member 320; a leaf spring 303; a middle plate 340; a bearing plate 360; a detent spring 374; a bottom plate 380; and a button 396. Preferably, the top plate 302 is comprised of polycarbonate; the middle plate 340 and bottom plate 380 are comprised of Delrin® 500; the leaf spring 303 and the detent spring 374 are comprised of hardened flat stainless steel or, alternatively, of spring steel 1075; the latch member 320 is comprised of steel 1075; the bearing plate 360 is comprised of a powdered metal, preferably 316L sintered stainless steel; and the button 396 is comprised of polycarbonate. Preferably, the detent follower 373 is comprised of a hardened sintered metal, for example, hardened sintered stainless steel.

The top plate 302 aligns and holds the mechanism 300 together. The top plate 302 is preferably arch-shaped, having a first side 303 not shown and a second side 304, with a substantially cylindrical aperture 306 extending through the first side and the second side 304. In the preferred embodiment, the aperture 306 has a diameter slightly greater than the diameter of the raised wall 206 (FIG. 2) of the antenna stem 200. The aperture 306 defines an interior surface 308 of the top plate 302. The interior surface 308 is substantially cylindrical having a flat portion 310 that mates with the flat portion 222 (FIG. 2) of the antenna stem 200 when the mechanism 300 and antenna stem 200 are coupled.

Disposed on the interior surface 308 of the top plate 302 is a plurality of keys 312, 314, 316, preferably three. The spacing of the keys 312, 314, 316 is such that the keys are slidably received in the key receptacles 224, 226, 228 (FIG. 2) of the antenna stem 200 when the stem bottom mates with the mechanism 300. Specifically, a first key 312 is centered around a point located approximately 80° from the center of the flat portion 310; a second key 314 is centered around a point located approximately 190° from the center of the flat portion 310; and a third key 316 is centered around a point located approximately 290° from the center of the flat portion 310. The top plate 302 also includes a first post 318, a second post 317, a tab 319 and a rectangular block 315 disposed on and perpendicular to the second side 304.

During assembly of the mechanism 300, the leaf spring 303 is coupled on a first side 305 to a bottom portion of the second side 304 of the top plate 302. One end 307 of the leaf spring 303 is disposed under the first post 318 and the other end 309 is disposed under the second post 317, leaving the middle portion of the spring 303 situated above the rectangular block 315. The leaf spring 303 assists in movement of the latch member 320 into a position for installation and removal of the antenna stem 200 (FIG. 2)

The latch member 320 is moveable to install and remove the antenna stem 200. The latch member 320 is generally arch shaped having a rectangular potion 322 at the top, and defines a second cylindrical hole 324. The hole 324 defines an interior surface having a first portion 328 and a second portion 330. The radius of the hole 324 with respect to the first portion 328 is preferably 10.6 mm and the radius of the hole 324 with respect to the second portion 330 is preferably 9.836 mm. Located adjacent the second cylindrical hole 324 is an opening 326 for receiving the tab 319 of the top plate 302 when the latch member 320 is coupled to the second side 304 thereof. The bottom surface 331 of the latch member 320 has a first aperture 327 and a second aperture 329 that are disposed above posts 317,318 of the top plate 302 when the latch member 320 is coupled to the top plate 302.

The middle plate 340 separates the detenting part of the mechanism 300 from the latching part of the mechanism 300 and retains the antenna stem 200 in the deployed positions (FIGS. 9 and 10). The middle plate 340 is preferably arch-shaped and defines a third cylindrical hole 342 having a diameter slightly greater than the raised wall 206 (FIG. 2) of the antenna stem 200. Disposed on an interior surface 344 of the middle plate 340 is a plurality of keys 346, preferably three. The interior surface 344 also defines a flat portion 347. The spacing of the keys 346 is preferably the same as the spacing of the keys 312, 314, 316 on the top plate 302. The middle plate 340 also includes two apertures 348 and a rectangular notch 350. The two apertures 348 are for receiving the posts 317, 318 disposed on the second side 304 of the top plate 302. The notch 350 is for receiving the tab 319 disposed on the second side 304 of the top plate 302.

Figure 4:
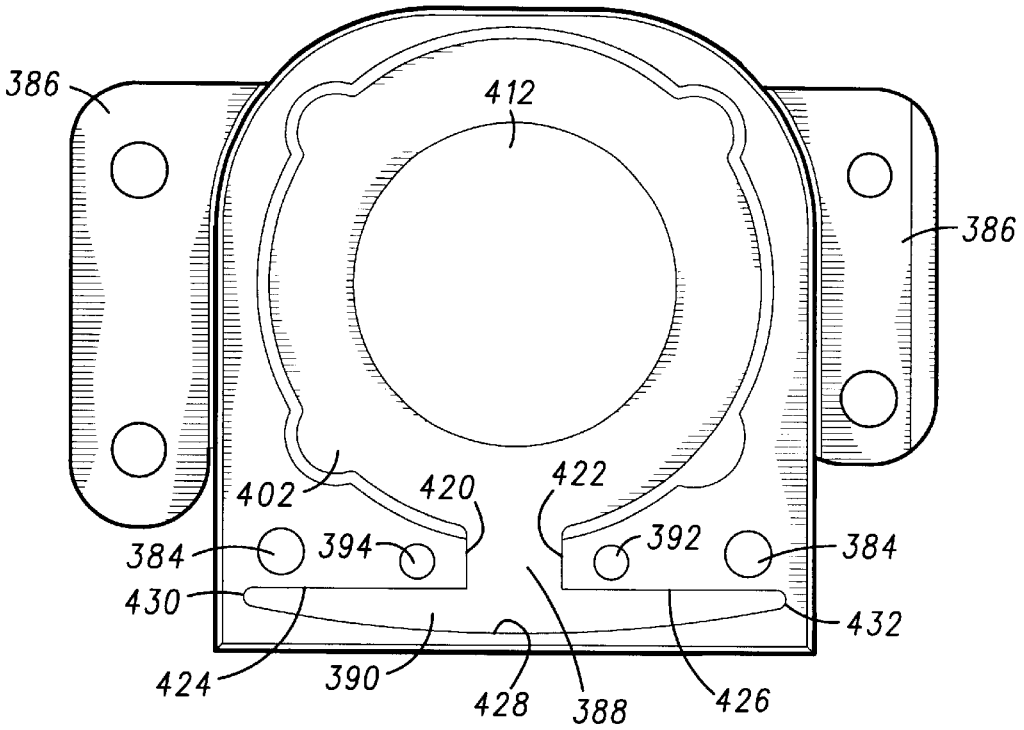
FIG. 4 is a front view of the bottom plate of the present invention.

In the preferred embodiment, the bottom plate 380 is arch-shaped and defines a recess having a first portion 402, a second portion 388, and a third portion 390 (FIG. 4). The first portion 402 is annular and has a diameter preferably the same as the diameter of the first and third cylindrical holes 306, 342 of the top and middle plates 302, 340, respectively. Formed in the first portion 402 of the recess is a fourth cylindrical hole 412. The second portion 388 of the recess is substantially rectangular, defined by a pair of substantially parallel walls 420, 422. The third portion 390 of the recess has an elongated shape, extending from a point 430 to a point 432. Walls 424, 426 meet with walls 420, 422, respectively, of the second portion 388. Walls 424, 426 extend to points 430, 432, respectively. Walls 424, 426 preferably define a substantially straight line between points 430, 432. Alternatively, walls 424, 426 may be curved. A notch, ledge, or other recess may be defined where walls 424, 426 meet with walls 420, 422, to receive detent spring contact surfaces 378, 377, respectively.

Wall 428 extends from point 430 to point 432 along a different path than walls 424, 426 so as to define the third portion 390 of the recess. Wall 428 may follow a curved path from point 430 to point 432. Alternatively wall 428 may be straight and, for example, substantially parallel to the adjacent external edge of bottom plate 380. If wall 428 is straight, additional walls may be provided between the extreme ends of wall 428 and points 430, 432. However, points 430, 432 should remain separated by a greater width than such additional walls so as to retain the ends of detent spring 374 (FIG. 3). For example, the additional walls, in combination with walls 424, 426, 428 may define a trapezoidal shape of the third portion 390 of the recess, with the trapezoidal shape having a greater width between points 430, 432 than along wall 428. As another example, notches or recesses may be defined at points 430, 432 to retain the ends of detent spring 374 regardless of the shapes and relationships of walls 424, 426, 428, and any additional walls that may be present.

The bottom plate 380 includes two apertures 384 (FIG. 3) for receiving the posts 317, 318 disposed on the second side 304 of the top plate 302. The bottom plate 380 also includes a plurality of projections 392, 394 to engage and maintain alignment with middle plate 340. The bottom plate further includes a plurality of mounting tabs 386 for coupling the mechanism 300 to the handset housing (not shown).

The bearing plate 360 (FIG. 3) interfaces with the antenna stem 200 (FIG. 2) to provide positioning. The bearing plate 360 preferably forms a ring having an interior side 362 and an exterior side 364. The interior side 362 forms a flat portion 363 and a plurality of keys 372, preferably three. The spacing of the keys 372 is substantially the same as the spacing of keys 346 and keys 312, 314, 316 of the middle plate 320 and top plate 302, respectively. Formed on the exterior side 364 of the bearing plate 360 is a plurality of detents 366, 368, 370, preferably three. A first detent 366 is centered around a point located approximately 45° from the center of the flat portion 363 (as reflected on the exterior side 364). A second detent 368 is centered around a point located approximately 180° from the center of the flat portion 363. A third detent 370 is centered around a point located approximately 315° from the center of the flat portion 363.

The detent spring 374 is preferably a substantially flat leaf spring. The detent spring 374 provides force against the detent follower 373 to keep the detent follower 373 in contact with the bearing plate 360 to provide positioning of the SSU antenna 800 (FIG. 8) with respect to the SSU handset 100 (see FIGS. 9 and 10). The detent follower 373 has a head 376, sides 512, 514 (FIG. 5), and two detent spring contact surfaces 377, 378. The two detent spring contact surfaces 377, 378 are formed as projections extending downward from detent follower 373. The two detent spring contact surfaces 377, 378 are preferably radiused to provide surfaces having convex curvature in contact with detent spring 374 to minimize friction. By providing a plurality of detent spring contact surfaces 377, 378, force resulting from deflection of the detent spring 374 is distributed. This distribution of force prevents the force from being concentrated and causing fatigue of the detent spring at a point of force concentration. A surface 510 lies between the two contact surfaces 377, 378.

During assembly of the mechanism 300, the bearing plate 360, the detent follower 373, and the detent spring 374 are received in the first portion 402, the second portion 388, and the third portion 390 of the bottom plate's 380 recess, respectively. The bearing plate 360 is disposed in the recess such that the flat portion 363 is aligned with the flat portions 310, 347 of the top plate 302 and middle plate 340, respectively. The detent follower 373 is disposed substantially within the second portion 388 of the recess, although the two detent spring contact surfaces 377, 378 may extend into the third portion 390 of the recess, and the detent follower may move between the second portion 388 and the third portion 390 of the recess.

Figure 5:
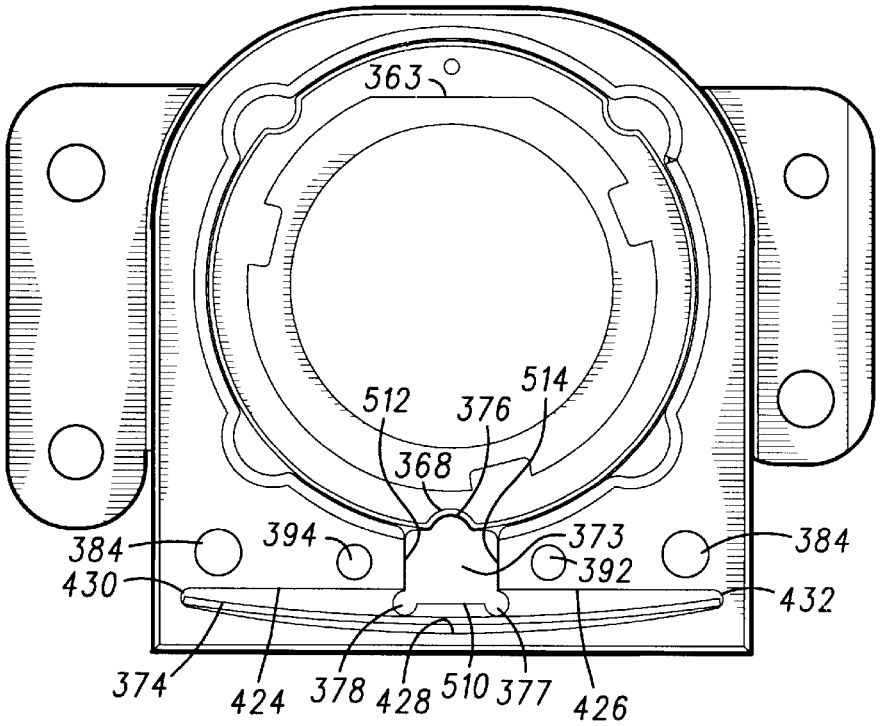
FIG. 5 is a front view of the bottom plate of FIG. 4 with the bearing plate and detent spring disposed therein.

The detent follower 373 engages the bearing plate 360 such that the head 376 of the detent follower 373 is received in detent 368 (see FIG. 5). The sides 512, 514 of the detent follower 373 are adjacent to walls 420, 422 and allowed to slide with respect to walls 420, 422. The detent spring 374 is disposed in the third portion 390 of the recess with the ends of the detent spring 374 positioned at points 430, 432. The detent spring 374 maintains contact with and provides force against the two detent spring contact surfaces 377, 378. The force against the two detent spring contact surfaces is transferred through detent follower 373 to forcefully engage the head 376 of detent follower 373 in any one of a plurality of detents 366, 368, 370, depending on the position of bearing plate 360.

If additional force is desired to ensure more positive detent action between the detent follower 373 and the detent 368, the detent spring 374 may be supplemented by adding an additional detent spring 375 adjacent to the detent spring 374. By stacking a plurality of additional detent springs 375 beneath detent follower 373, any desired force may be provided. Alternatively, the thickness or temper of detent spring 374 may be changed to provide any desired force.

Figure 6:
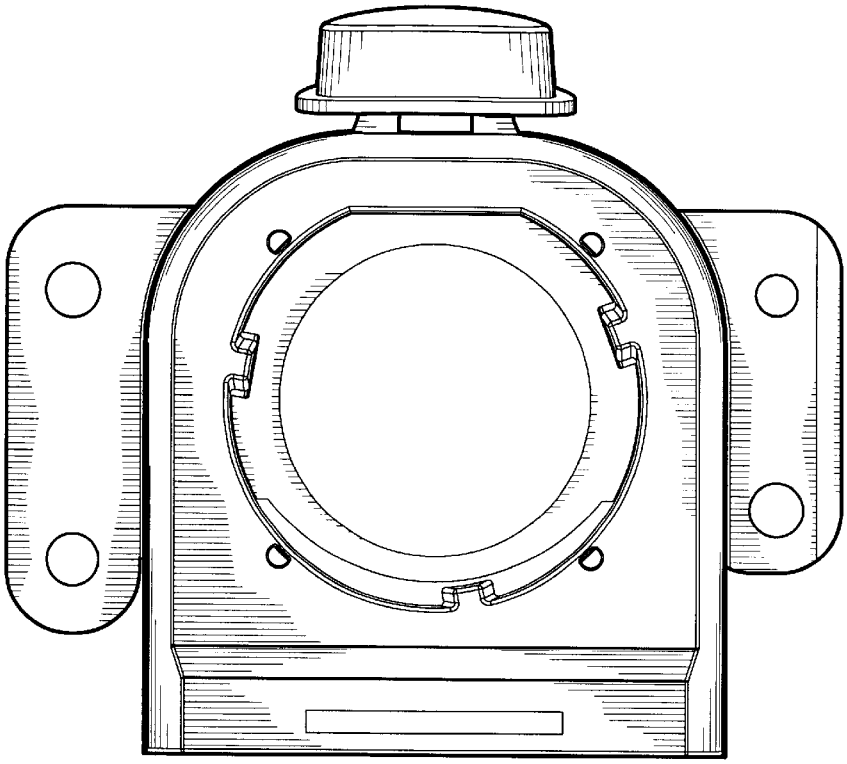
FIG. 6 is a front view of the preferred embodiment of the assembled antenna detent and latching mechanism of FIG. 3 with the latch member in a disengaged position.
Figure 7:
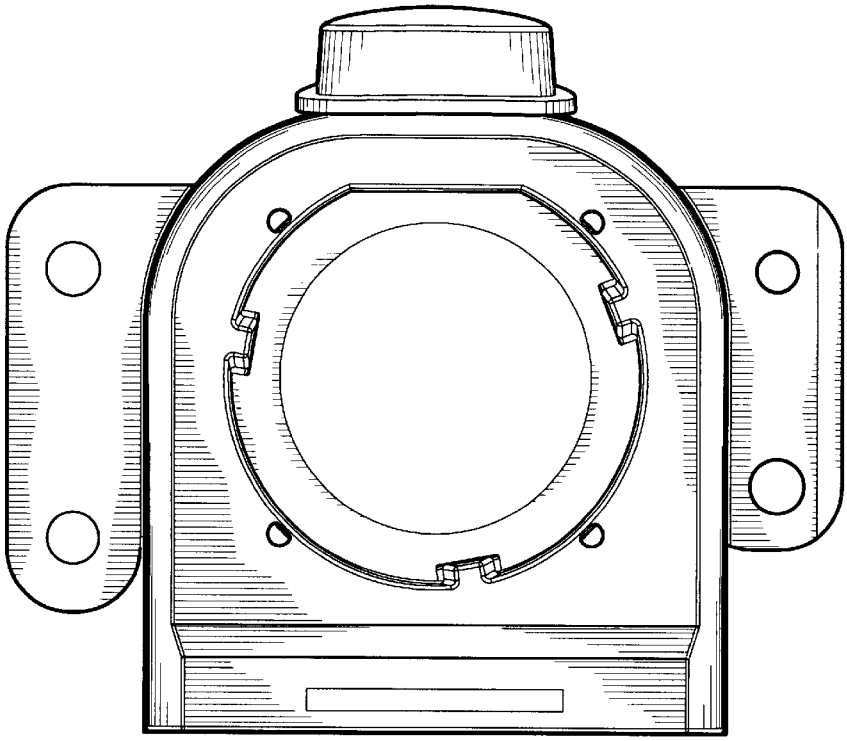
FIG. 7 is a front view of the preferred embodiment of the assembled antenna detent and latching mechanism of FIG. 3 with the latch member in an engaged position.

When the mechanism 300 is fully assembled as shown in FIGS. 6 and 7, and coupled to the handset 100 as shown in FIG. 1, it is used in conjunction with the raised wall 206 of the antenna stem 200 to maintain the antenna in a stowed (or inactive) position (FIG. 8), a first deployed (or active) position (FIG. 9), or a second deployed position (FIG. 10).

FIG. 6 shows the mechanism 300 in a disengaged position (position when the antenna 800 (FIG. 8) is not coupled to the handset 100). In the disengaged position, the second portion 330 of the latch member 320 blocks a part of the first cylindrical hole 306 of the top plate 302 and prevents the antenna stem 200 from coupling to the mechanism 300. When a user wants to couple the SSU antenna 800 to the handset 100, the mechanism 300 is engaged as follows. First the user presses the button 396 (FIG. 1) disposed above a top surface of the handset 100. The button 396 asserts a downward force on the rectangular portion 322 of the latch member 320. This downward force moves the latch member 322 downward until the second portion 330 of the interior surface 326 of the latch member 320 is aligned with the first cylindrical hole 306 of the top plate 302, as shown in FIG. 7. This allows the mechanism 300 to receive the raised wall 206 of the antenna stem 200 when the raised wall 206 is oriented such that its key receptacles 224, 226, 228 (FIG. 2) are aligned with the keys 312, 314, 316, 346, 372 (FIG. 3) of the mechanism 300. Once the raised wall 206 is received in the mechanism 300, the user can release the button 396 on the handset 100 and the mechanism 3200 will be held in place.

Figure 8:
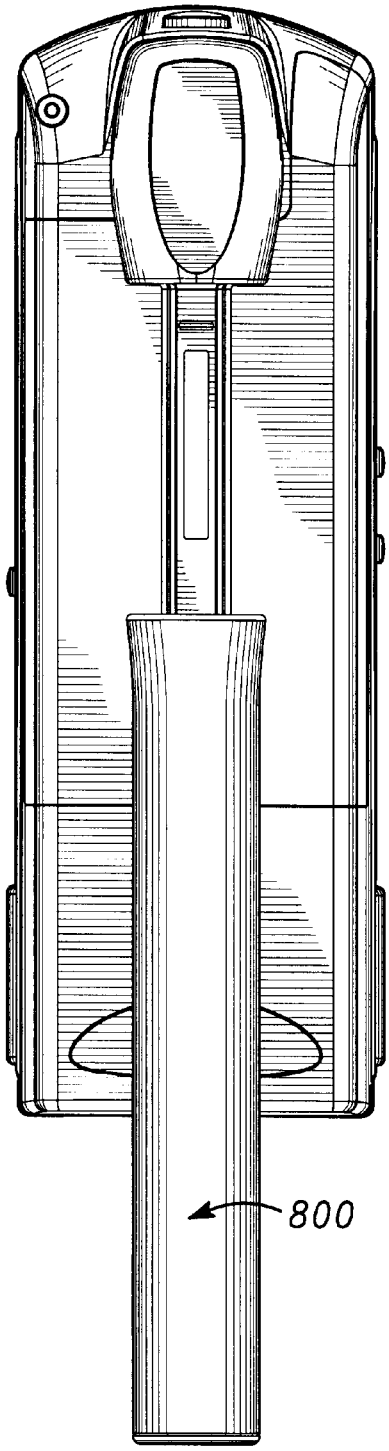
FIG. 8 is a rear view of an SSU with the antenna in a stowed position.

FIG. 8 shows the antenna 800 in a stowed (or inactive position). When the antenna 800 is in the stowed position, the head 376 of the detent follower 373 is disposed in detent 368 of the bearing plate. From the stowed position, the antenna 800 can be rotated in a clockwise direction to the first deployed position (FIG. 9). Clockwise rotation of the antenna to the first deployed position causes the bearing plate 360 to move in a clockwise direction until the head 376 of the detent follower 373 snaps into detent 370. Further clockwise rotation of the antenna to the second deployed position (FIG. 10) causes the bearing plate 360 to move clockwise until the head 376 of the detent follower 373 snaps into detent 366. The antenna can also be rotated to the deployed positions in a counterclockwise direction in a similar manner as described above. The first deployed position would likely be used by a left-handed person holding the SSU to his or her left ear. The second deployed position would likely be used by a right-handed person holding the SSU to his or her right ear.

The antenna detent and latching mechanism 300 of the present invention allows the SSU to transmit and receive signals only when the antenna 800 is in the appropriate deployed position. The mechanism 300 also ensures that the antenna 800 is maintained in a vertical orientation with respect to the ground throughout a call regardless of whether the user is holding the SSU with his or her right hand.

The detent follower 373, together with detent spring 374, increases the tolerance for wear from interaction with bearing plate 360. The two detent spring contact surfaces 377, 378 of detent follower 373 spread force applied by detent spring 374, thereby reducing the likelihood of fatigue of detent spring 374. Furthermore, the use of a substantially flat detent spring 374 obviates the need for a specially formed detent spring, thereby simplifying manufacturing and lowering cost. Moreover, the use of a substantially flat detent spring allows the use of additional detent springs to provide additional force.

Those skilled in the art will recognize that various modifications and variations can be made in the apparatus of the present invention and in construction of this apparatus without departing from the scope or spirit of this invention.

It should be understood that the implementation of other variations and modifications of the invention in its various aspects will be apparent to those of ordinary skill in the art, and that the invention is not limited by the specific embodiments described. It is therefore contemplated to cover by the present invention, any and all modifications, variations, or equivalents that fall within the spirit and scope of the basic underlying principles disclosed and claimed herein.

What is claimed is:

1. An antenna detent and latching mechanism for coupling to a radiotelephone and mating with a radiotelephone antenna stem, the mechanism comprising:

a bearing plate defining a plurality of detents in an exterior side of the bearing plate, wherein the bearing plate interfaces with the antenna stem to provide positioning of the antenna stem with respect to the radiotelephone;

a detent follower coupled to the bearing plate and engaging at least one of the plurality of detents; and a detent spring coupled to the detent follower and providing force against the detent follower.

2. The mechanism of claim 1 wherein the detent spring is substantially flat.

3. The mechanism of claim 2 wherein the detent follower includes at least one detent spring contact surface.

4. The mechanism of claim 3 further comprising:

a bottom plate coupled to the bearing plate to mount the mechanism in the radiotelephone, wherein the bottom plate forms a recess for receiving the bearing plate, the detent follower, and the detent spring.

5. The mechanism of claim 4 further comprising:

a middle plate coupled to the bearing plate and retaining the antenna stem in a first deployed position or a second deployed position;

a latch member coupled to the middle plate and moveable to allow the antenna stem to be coupled to the mechanism;

a leaf spring coupled to the latch member;

a button for actuating the latch member to install and remove the antenna stem; and a top plate coupled to the latch member for aligning the mechanism.

6. The mechanism of claim 1 wherein the detent spring comprises a stacked plurality of detent springs.

7. An antenna detent and latching mechanism for mating with a raised wall of an antenna stem, the antenna detent and latching mechanism comprising:

a top plate having a first side and a second side;

a leaf spring having a top side, a first side, and a second side, wherein the first side is coupled to the second side of the top plate;

a latch member having a first side coupled to the second side of the top plate and having a bottom side coupled to the top side of the leaf spring;

a middle plate having a first side and a second side wherein the first side is coupled to the second side of the leaf spring and the second side of the top plate;

a bottom plate having a first side and a second side, wherein the first side defines a recess having a first portion, a second portion and a third portion;

a bearing plate disposed within the first portion of the recess;

a detent follower disposed substantially within the second portion of the recess; and a detent spring disposed within the third portion of the recess, wherein the bottom plate, the bearing plate, the detent follower, and the detent spring are coupled to the second side of the middle plate.

8. The antenna detent and latching mechanism of claim 7 wherein the top plate is substantially arch shaped and defines a first aperture extending through the first side and the second side of the top plate.

9. The antenna detent and latching mechanism of claim 8 wherein the first aperture defines a first wall having a first annular portion and a linear portion and wherein a first plurality of keys is disposed on the first annular portion.

10. The antenna detent and latching mechanism of claim 7 wherein a first post, a second post, a first tab, and a second tab are coupled to the second side of the top plate.

11. The antenna detent and latching mechanism of claim 8 wherein the latch member defines a second aperture with a first portion having a diameter greater than a diameter of the first aperture and with a second portion having a diameter less than the diameter of the first aperture.

12. The antenna detent and latching mechanism of claim 10 wherein the latch member has an opening in a top portion for receiving the first tab when the latch member is coupled to the second side of the top plate, and wherein the bottom side of the latch member has a first notch that mates with the first post and a second notch that mates with the second post when the latch member is coupled to the second side of the top plate.

13. The antenna detent and latching mechanism of claim 10 wherein a first end of the leaf spring is disposed under the first post and a second end of the leaf spring is disposed under the second post when the leaf spring is coupled to the second side of the top plate.

14. The antenna detent and latching mechanism of claim 10 wherein the middle plate defines a slot for receiving the first tab when the middle plate is coupled to the top plate.

15. The antenna detent and latching mechanism of claim 10 wherein the first side of the middle plate defines a cavity having a first hole and a second hole extending through the second side of the middle plate, wherein the leaf spring is received in the cavity and the first post and the second post are received in the first hole and the second hole, respectively.

16. The antenna detent and latching mechanism of claim 9 wherein the middle plate defines a third aperture extending through the first side and the second side of the middle plate, wherein the third aperture defines a second wall having a second annular portion and a second linear portion, the second wall having a second plurality of keys disposed on the second annular portion such that the second plurality of keys is aligned with the first plurality of keys when the middle plate is coupled to the top plate.

17. The antenna detent and latching mechanism of claim 7 wherein the antenna stem comprises:

a base; and a raised wall coupled to the base and having a bore therethrough, the raised wall having an inner surface and an outer surface wherein the outer surface defines a plurality of key receptacles that receive a first plurality of keys, a second plurality of keys, and a third plurality of keys of the antenna detent and latching mechanism when the antenna stem is coupled to the antenna detent and latching mechanism.

18. The antenna detent and latching mechanism of claim 17 wherein a first plurality of key receptacles is formed on the outer surface of the raised wall and centered around a point P1 located approximately 80 degrees from a point P, a second plurality of key receptacles is formed on the outer surface of the raised wall and centered around a point P2 located approximately 190 degrees from point P, and a third of the plurality of key receptacles is formed on the outer surface of the raised wall and centered around a point P2 located approximately 290 degrees from point P.

19. The antenna detent and latching mechanism of claim 18 wherein the outer surface of the raised wall further defines a plurality of pairs of grooves, wherein each pair of grooves is located between an adjacent pair of key receptacles.

20. A radiotelephone having an antenna with an antenna stem, a transmitter, a receiver, and an antenna detent and latching mechanism, wherein the antenna detent and latching mechanism comprises:

a bottom plate for mounting the mechanism in the radiotelephone;

a bearing plate coupled to the bottom plate, wherein the bearing plate interfaces with the antenna stem to provide positioning of the antenna stem with respect to the radiotelephone;

a detent follower coupled to the bearing plate and engaging one of a plurality of detents in the bearing plate;

a detent spring coupled to the bottom plate and providing force against the detent follower to assist in positioning;

a middle plate coupled to the bearing plate and retaining the antenna stem in a first deployed position or a second deployed position;

a latch member coupled to the middle plate and moveable to allow the antenna stem to be coupled to the mechanism;

a leaf spring coupled to the latch member;

a button for actuating the latch member to install and remove the antenna stem; and a top plate coupled to the latch member for aligning the mechanism.

* * * * *